US012709962B2

(12) United States Patent
Roundtree

(10) Patent No.: US 12,709,962 B2
(45) Date of Patent: Aug. 18, 2026

(54) METHODS AND DEVICES FOR RETAINING CONVEYED HEAT UP A WELLBORE

(71) Applicant: Gradient Geothermal Inc, Denver, CO (US)

(72) Inventor: Russell Roundtree, Golden, CO (US)

(73) Assignee: Gradient Geothermal, Inc, Denver, CO (US)

( * ) Notice: Subject to any disclaimer, the term of this patent is extended or adjusted under 35 U.S.C. 154(b) by 0 days.

(21) Appl. No.: 19/264,785

(22) Filed: Jul. 9, 2025

(65) Prior Publication Data

US 2026/0015921 A1 Jan. 15, 2026

Related U.S. Application Data

(60) Provisional application No. 63/670,642, filed on Jul. 12, 2024.

(51) Int. Cl.

| | |
|---|---|
| ***E21B 36/00*** | (2006.01) |
| ***E21B 33/124*** | (2006.01) |
| ***E21B 47/06*** | (2012.01) |
| ***E21B 47/117*** | (2012.01) |

(52) U.S. Cl.
CPC ..... *E21B 36/003* (2013.01); *E21B 33/124* (2013.01); *E21B 47/06* (2013.01); *E21B 47/117* (2020.05)

(58) Field of Classification Search
CPC ..... E21B 36/003
See application file for complete search history.

(56) References Cited

U.S. PATENT DOCUMENTS

| | | | | |
|---|---|---|---|---|
| 3,380,530 | A * | 4/1968 | Mcconnell | E21B 36/00 166/57 |
| 2013/0192834 | A1* | 8/2013 | Schneider | E21B 36/003 166/57 |
| 2014/0318770 | A1* | 10/2014 | Hallundbæk | E21B 47/06 166/250.12 |
| 2020/0101505 | A1* | 4/2020 | Quigley | B09B 1/00 |
| 2020/0217181 | A1* | 7/2020 | Norbeck | F03G 4/033 |

* cited by examiner

*Primary Examiner* — Kristyn A Hall
(74) *Attorney, Agent, or Firm* — NOD Law PC

(57) ABSTRACT

A system to retain heat in a production fluid being extracted via a wellbore includes a casing extending in the wellbore, the casing having an internal space; a tubing string extending within the internal space, the tubing string configured to transport the production fluid; an annular space located between the tubing string and the casing; and a gas having a thermal conductivity below 0.67 W/m·K filling the annular space. Other systems and methods are disclosed.

19 Claims, 8 Drawing Sheets

METHODS AND DEVICES FOR RETAINING CONVEYED HEAT UP A WELLBORE

PRIORITY

This application claims priority to U.S. provisional patent application 63/670,642 filed on Jul. 12, 2024, for Method For Retaining Conveyed Heat Up A Wellbore To Maximize Geothermal Heat Recovery, which is hereby incorporated by reference for all that is disclosed therein.

FIELD OF THE DISCLOSURE

The present disclosure relates generally to retaining conveyed heated fluids up a wellbore to maximize geothermal heat recovery. In particular, but not by way of limitation, the present disclosure relates to systems, methods, and apparatuses for evacuating normal fluid and possible hydrocarbons existing between a tubing string and a casing string of a wellbore, and replacing that fluid with a gas having low thermal conductivity.

BACKGROUND

Water vapor and other high-energy gases are used to spin turbines and generate electricity. This technology is used to provide electricity to equipment associated with drilling, such as oilfield equipment. Hot fluids are transferred from wells to the surface by way of bores or shafts and are used heat gases that, in turn, are used to generate electricity. Conventional wellbores have high thermal conductivity, which cools the fluids as they move through the bores. Consequently, much of the thermal energy of the fluids is lost before the fluids arrive at the surface, which reduces the efficiency of electricity production.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
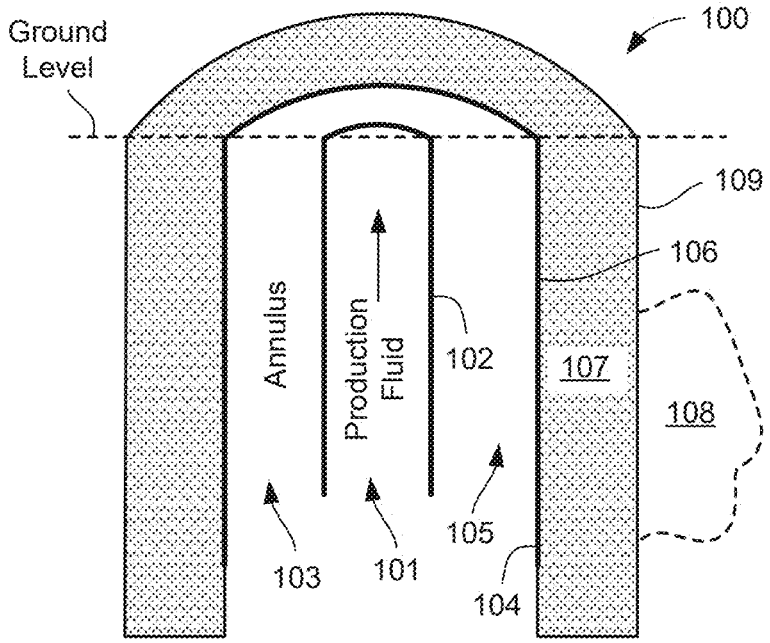
FIG. 1 illustrates a topology showing a flow of thermally heated fluid moving up a wellbore according to one or more embodiments.

Preliminary note: the flowcharts and block diagrams in the following Figures illustrate the architecture, functionality, and operation of possible implementations of systems, methods and computer program products according to various embodiments of the present disclosure. In this regard, some blocks in these flowcharts or block diagrams may represent a module, segment, or portion of code, which comprises one or more executable instructions for implementing the specified logical function(s). It should also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

Additionally, the flowcharts and block diagrams in the Figures illustrate the functionality and operation of possible implementations of the disclosure according to various embodiments of the present disclosure. It should be noted that, in some alternative implementations, the functions noted in each block may occur out of the order noted in the figures. For example, two blocks shown in succession may, in fact, be executed substantially concurrently, or the blocks may sometimes be executed in the reverse order, depending upon the functionality involved.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the scope of the disclosure. Thus, the present disclosure is not intended to be limited to the embodiments shown herein but is to be accorded the widest scope consistent with the principles and novel features disclosed herein.

As fluid is extracted via a wellbore, the fluid moves past the inside wall of a tubing string of the wellbore. Convective heat transfer provides a mechanism for heat loss from the traveling fluid to the wall of the tubing string. Once the wall heats up, conduction transfers the heat through the tubing string and into an annular space between the tubing string and a casing of the wellbore. Heat loss continues through the casing, to a cement sheath, and finally into a stack of rocks that were previously drilled through to form the wellbore.

Devices and methods disclosed herein reduce the heat loss of the fluid as the fluid passes through tubing strings in wellbores. As described herein, the thermal conductivity of any of the heat conducting pathways from the fluid inside the tubing string and the surrounding rock formations through which the wellbores pass is reduced. Portions of this disclosure describe processes of replacing a fluid in annular spaces between two pipe strings with a gas having low thermal conductivity, such as nitrogen, air, or carbon dioxide. This low thermally conductive layer now becomes a very good insulator impeding the conductive heat flow out of the traveling fluid. In some embodiments, heat loss is reduced by a factor of approximately 20.

Reference is made to FIG. 1, which illustrates a cutaway view of an embodiment of a wellbore 100 used to transfer a production fluid 101 from an underground reservoir to the surface and retain heat in the production fluid 101. FIG. 1 also illustrates a topology affecting the transfer of heat from the production fluid 101 moving up the wellbore 100. The production fluid 101 moves up a center tubing string 102 extending from the surface to the reservoir or the production fluid 101. In some embodiments, the production fluid 101 within the tubing string 102 may include hydrocarbons and/or water, moving at high velocities due to reservoir pressures or artificial lift systems. As the production fluid 101 moves upwards, it loses heat through convective transfer to the wall of the tubing string 102. The efficiency of this heat transfer is influenced by the flow rate and temperature of the production fluid 101 as well as the thermal conductivity of the material of the tubing string 102 and other materials in the wellbore 100.

In some embodiments, the tubing string 102 may be made of various materials, including, but not limited to, metal, fiberglass, plastics, or the like. In some embodiments, the tubing string 102 material is selected for its ability to withstand high temperatures and pressures. The tubing string 102 can be a variety of diameters, ranging from 1" to 6", and more typically 2⅜" or 2⅞" in diameter, for example. Larger diameters may be used in various embodiments for higher flow rate wells. In some embodiments, insulated material may be used with the tubing string 102 to further reduce heat loss from the production fluid 101. However, insulating materials may be cost-prohibitive.

In some embodiments, the speed of the production fluid 101 convectively transfers heat from the production fluid 101 to the tubing string 102. The heat in the tubing string 102 conductively moves into an annular space 103 (or annulus) between the tubing string 102 and an outer casing string (or casing) 104. The casing 104 may be described as having an internal space as described herein, wherein the tubing string 102 is located in the internal space. In some conventional embodiments, the annular space 103 may be filled with reservoir fluids, which may have high thermal conductivity. These reservoir fluids can include a variety of materials including liquids and hydrocarbons. In such conventional embodiments, the coefficient of thermal conductivity for the fluids in the annular space 103 may be greater than 0.67 W/m·K, for example.

After heat is transferred to the casing 104, the heat may conduct very quickly through the material of the casing 104 to an inside wall 106 of the casing 104. In some embodiments, the casing 104 may serve as a structural barrier. For example, the casing 104 may be made of high-grade steel to withstand the mechanical and thermal stresses encountered during well operations. High thermal conductivity of the steel or other material may increase the heat transfer from the production fluid through the casing 104.

After the heat is transferred to the outside wall 109 of the casing 104, the heat may encounter a solidified cement slurry sheath 107. In some embodiments, the cement sheath 107 surrounding the casing 104 provides both structural support and zonal isolation, which minimizes or prevents cross-flow of fluids between different geological formations. In some embodiments, the sheath 107 moderates the heat. The sheath 107 may also be used to isolate the wellbore 100 and provide safety against the harmful flow of reservoir fluids that could contaminate freshwater aquifers at shallower zones within the well. The sheath 107 may further conduct heat away from the production fluid 101 and into the surrounding rock formations 108. In some embodiments, the rock formations 108 act as a heat sink, dispersing the thermal energy away from the wellbore 100 and the production fluid 101, which can reduce the efficiency of electricity production using the production fluid 101.

The systems, apparatus, and methods described herein reduce the heat transfer from the tubing string 102 to the casing 104. In some embodiments disclosed herein, at least a portion of the reservoir fluid or other fluid in the annular space 103 may be replaced with a gas 105 having a low thermal conductivity, such as less than 0.67 W/m·K. Examples of gases having low thermal conductivity include, but are not limited to nitrogen, carbon dioxide, or any other low thermally conductivity gas. For example, in some embodiments, nitrogen may be used to fill the annular space 103, which reduces the coefficient of thermal conductivity relative to a reservoir fluid that may fill the annular space 103 of a conventional system. In some embodiments, nitrogen gas may fill the annular space 103, which reduces the coefficient of thermal conductivity to about 0.032 W/m·K. In some embodiments, the gas may contain at least 95% nitrogen. In some other embodiments, the gas may comprise at least 50 percent carbon dioxide.

The low thermally conductive gas 105 is significantly more insulative and impedes the normal flow of heat from the tubing string 102 to the casing 104 than a reservoir fluid or a slurry located in the annular space 103 of a conventional wellbore. As such, replacing fluids in the annular space 103 with the low thermally conductive gas 105 reduces heat loss from the tubing string 102 to the casing 104 relative to conventional wellbores. In some embodiments, replacing fluids in the annular space 103 with the low thermally conductive gas 105 also helps maintain the thermal integrity of the production fluid 101, which can be helpful in heavy oil or waxy crude production where temperature maintenance is important to prevent viscosity increases and flow issues.

Figure 2:
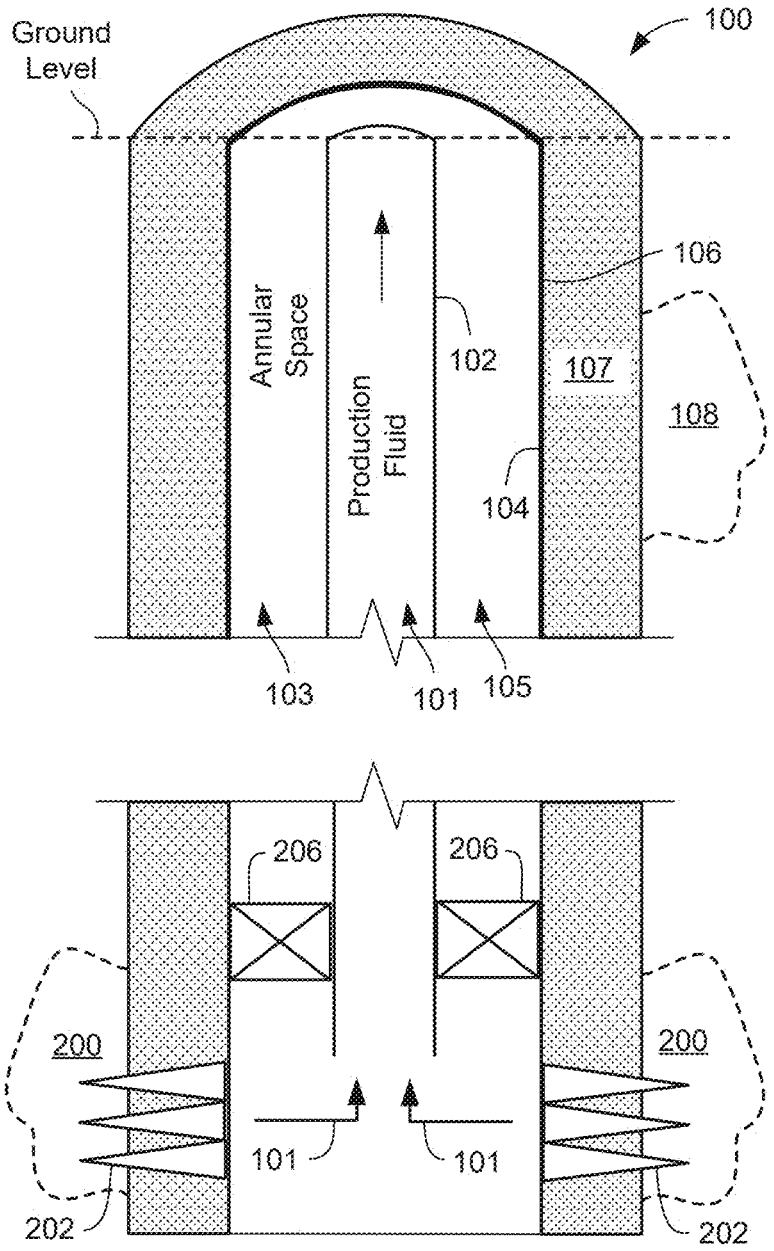
FIG. 2 is a schematic diagram showing a base of the wellbore of FIG. 1 wherein thermally heated fluid flows out of a permeable formation according to one or more embodiments.

Additional reference is made to FIG. 2, which illustrates a schematic diagram detailing embodiments at the base of the wellbore 100 wherein the production fluid 101 flows out of a permeable formation 200, in accordance with various embodiments of the disclosure. In some embodiments, the production fluid 101 may enter the wellbore 100 through explosively formed perforation holes 202 that penetrate both the casing 104 and the surrounding sheath 107. Techniques such as laser perforation or hydraulic jet perforation may be used to form the perforation holes 202. In some embodiments, the perforation holes 202 extend into the permeable formations 200.

In other embodiments, the wellbore 100 may be formed by an "open hole" completion. In such embodiments, the casing 104 is run over the reservoir formation, which allows a reservoir rock face to be in direct contact with the inside of the wellbore 100. This contact facilitates natural flow of the production fluid 101 through open pore spaces and natural fractures in the permeable formations 200. In some embodiments of open hole completions, sand control measures such as gravel packing or the installation of sand screens are implemented to prevent or minimize the influx of formation sand while allowing the production fluid 101 to flow more readily into the wellbore 100.

During operation of the wellbore 100, the production fluid 101 enter the wellbore 100 and begins ascending through the tubing string 102. In the embodiments described herein, the annular space 103 between the casing 104 and the tubing string 102 may be isolated or bounded by a packer 206 that prevents fluid flow up the annular space 103. The packer 206 can be of various types. For example, in some embodiments, the packer 206 may be a mechanical actuation packer that is set by mechanically manipulating the tubing string 102, typically through rotation or compression, to expand and seal the annular space 103.

In other embodiments, the packer 206 may be a fluid pressure activated packer, which uses pressure of the well fluids to activate and expand and seals the annular space 103. A fluid pressure activated packer may respond to specific pressure thresholds to ensure a secure seal between the tubing string 102 and the 104. In other embodiments, the packer 206 may be a swell packer that is made of a flexible material that interacts with the well fluids (i.e., water or the production fluid 101). The swell packer swells upon contact with the well fluids to form the seal between the tubing string 102 and the casing 104. The material used in swell packers may expand significantly upon exposure to specific wellbore fluids to create a tight seal.

The production fluid 101 is directed into the tubing string 102 upon entering the wellbore 100. The tubing string 102 is designed to transport the production fluid 101 to the surface. The packer 206 ensures that the production fluid 101 does not bypass the tubing string 102 through the annular space 103, thereby facilitating well integrity and minimizing unwanted fluid migration. In addition to isolating the annular space 103, the packer 206 may also manage or maintain pressure within the wellbore 100. The choice of packer type (e.g., mechanical, pressure-activated, or swell) depends on various factors, including well depth, fluid viscosity, and operational conditions. As such, in some embodiments, one or more sensors and/or control mechanisms detects various well conditions and uses this data to determine which type of packer 206 to deploy.

Figure 3:
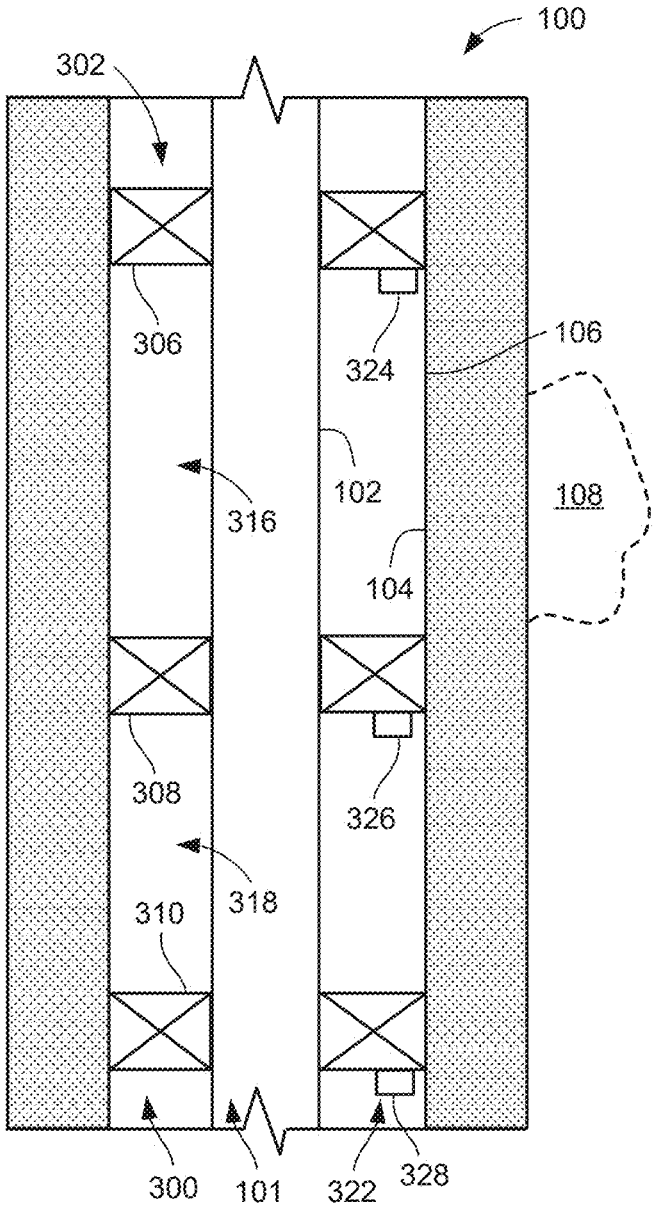
FIG. 3 is a schematic diagram of a portion of a wellbore including a plurality of packers that form a plurality of annular spaces according to one or more embodiments.

Additional reference is made to FIG. 3, which illustrates a schematic diagram of an embodiment of a portion of the wellbore 100 including a plurality of packers 300 that form a plurality of annular spaces 302. The packers 300 may be identical or substantially similar to the pack 206 of FIG. 2. In the example of FIG. 3, the wellbore 100 includes a first packer 306, a second packer 308, and a third packer 310. A first annular space 316 is formed between the first packer 306 and the second packer 308. A second annular space 318 is formed between the second packer 308 and the third packer 310. The first annular space 316 and/or the second annular space 318 may be filled with the gas 105 as described herein having a low thermal conductivity. In some embodiments, the first annular space 316 may be filled with a first low thermally conductive gas and the second annular space 318 may be filled with a second low thermally conductive gas. For example, the operating or construction of the wellbore 100 may operate with the first low thermally conductive gas in the first annular space 316 and the second low thermally conductive gas in the second annular space 318. In addition, the plurality of packers 300 may facilitate managing different pressure zones or fluid compositions within the plurality of annular spaces 302.

In some embodiments, one or more sensors 322 and/or control mechanisms may be incorporated into or associated with the packers 300 to facilitate real-time monitoring and adjustment of the packers 300. In the example of FIG. 3, a first sensor 324 and/or control mechanism may be incorporated into or associated with the first packer 306, a second sensor 326 and/or control mechanism may be incorporated into or associated with the second packer 308, and a third sensor 328 and/or control mechanism may be incorporated into or associated with the third packer 310. The sensors 322 and/or control mechanisms may be configured to communicate various well conditions, such as pressure or temperature variations in one or more of the annular spaces 302. The packers 300 or a controller in communication with the packers 300 can then respond to these well conditions in order to maintain optimal sealing performance. For example, in some embodiments, the first sensor 324 on the first packer 306 may communicate a pressure variation. In response to this communication, the second packer 308 may be controlled by a control mechanism (e.g., annular space controller 508-FIG. 5) to adapt to the sensed pressure variation.

Figure 4:
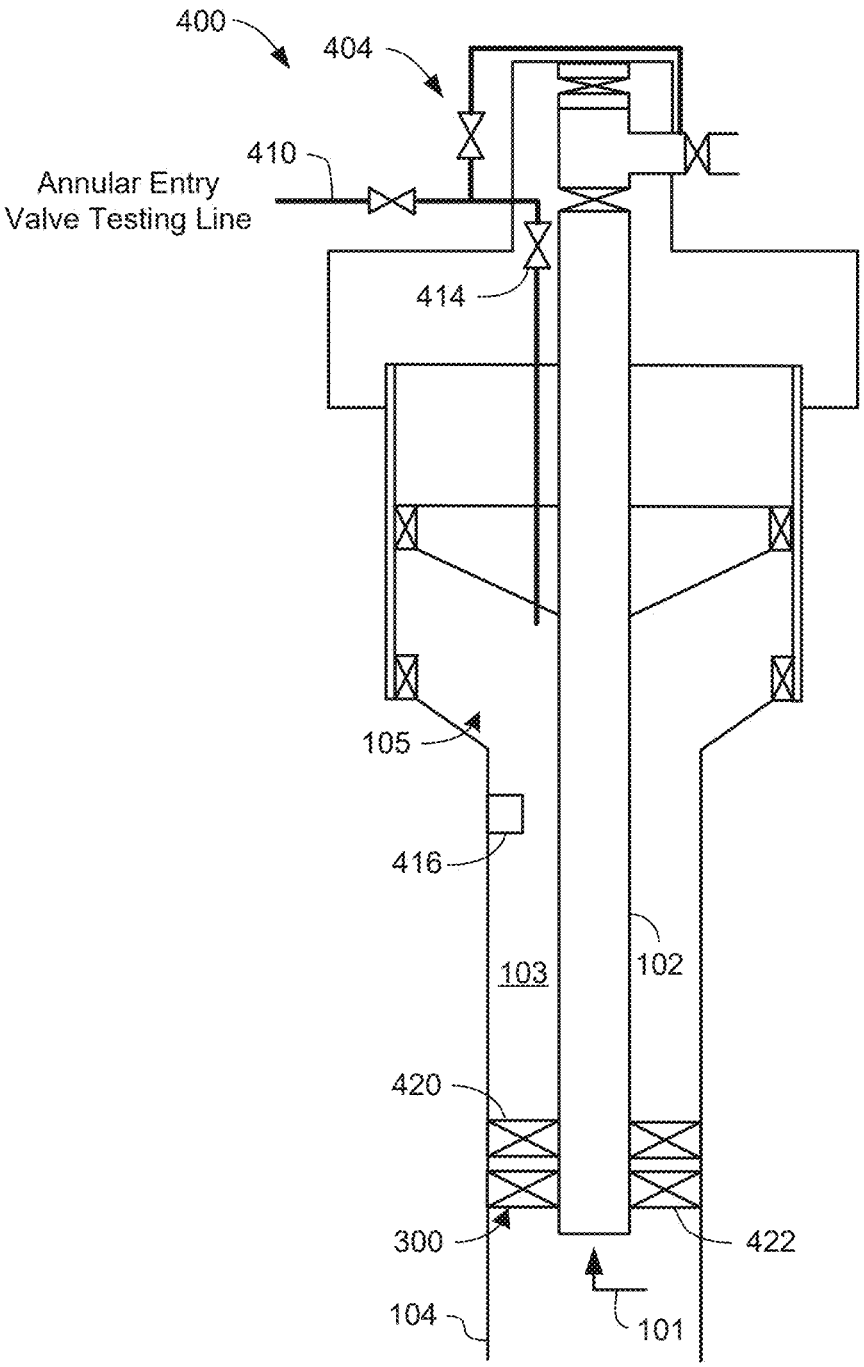
FIG. 4 is a schematic diagram of a wellbore according to one or more embodiments.

Additional reference is made to FIG. 4, which is a schematic diagram illustrating an embodiment of a wellhead 400, in accordance with various embodiments of the disclosure. The wellhead 400 is an embodiment of a surface termination of the wellbore 100 (FIG. 2) and may serve as the structural and pressure-containing interface for drilling and production equipment. The wellhead 400 may include various components, including a casing head, a tubing head, and a Christmas tree, which may include a plurality of valves 404 and fittings designed to control the flow of the production fluid 101. In some embodiments, the wellhead 400 includes one or more valves that allow or prevent access of production fluid 101 passing from the wellhead 400 to a take-away flow line 410 routing the production fluid 101 to other surface processing facilities.

An annular pressure valve 414 and a gauge 416 may be used to control fluids passing from the wellhead 400 to the take-away flow line 410. The low thermally conductive gas 105 used in the annular space 103 may be under considerable pressure to flush the annular space 103 prior to setting the packers 300. This pressure may be controlled by the annular pressure valve 414 and monitored by the gauge 416 to ensure minimal leaking of the production fluid 101 into the annular space 103. For example, the annular pressure valve 414 and gauge 416 may be used to regulate the pressure in the annular space 103 to ensure that the pressure remains within an optimal range. If the pressure drops or production fluid 101 is detected in the annular space 103, the gauge 416 may identify and/or communicate a potential leak or failure to one or more of the packers 300. In some embodiments, the gauge 416 may be incorporated into one or more of the sensors 322 (FIG. 3). If a leak is detected in a packer, then a well "work-over" may be implemented. The well work-over may include pumping additional low thermally conductive gas 105 into the annular space 103 to restore the pressure and improve the seal provided by the packer.

In some embodiments, the wellbore may include redundant sealing mechanisms between the tubing string 102 and the casing 104. For example, the wellbore may include a secondary packer 420 or sealant material that activates if a packer fails. In the example of FIG. 4, the lower boundary of the annular space 103 includes two packers, a first packer 420 and a second packer 422. If one of the packers fails, the other packer is present to prevent the above-described problems.

Figure 5:
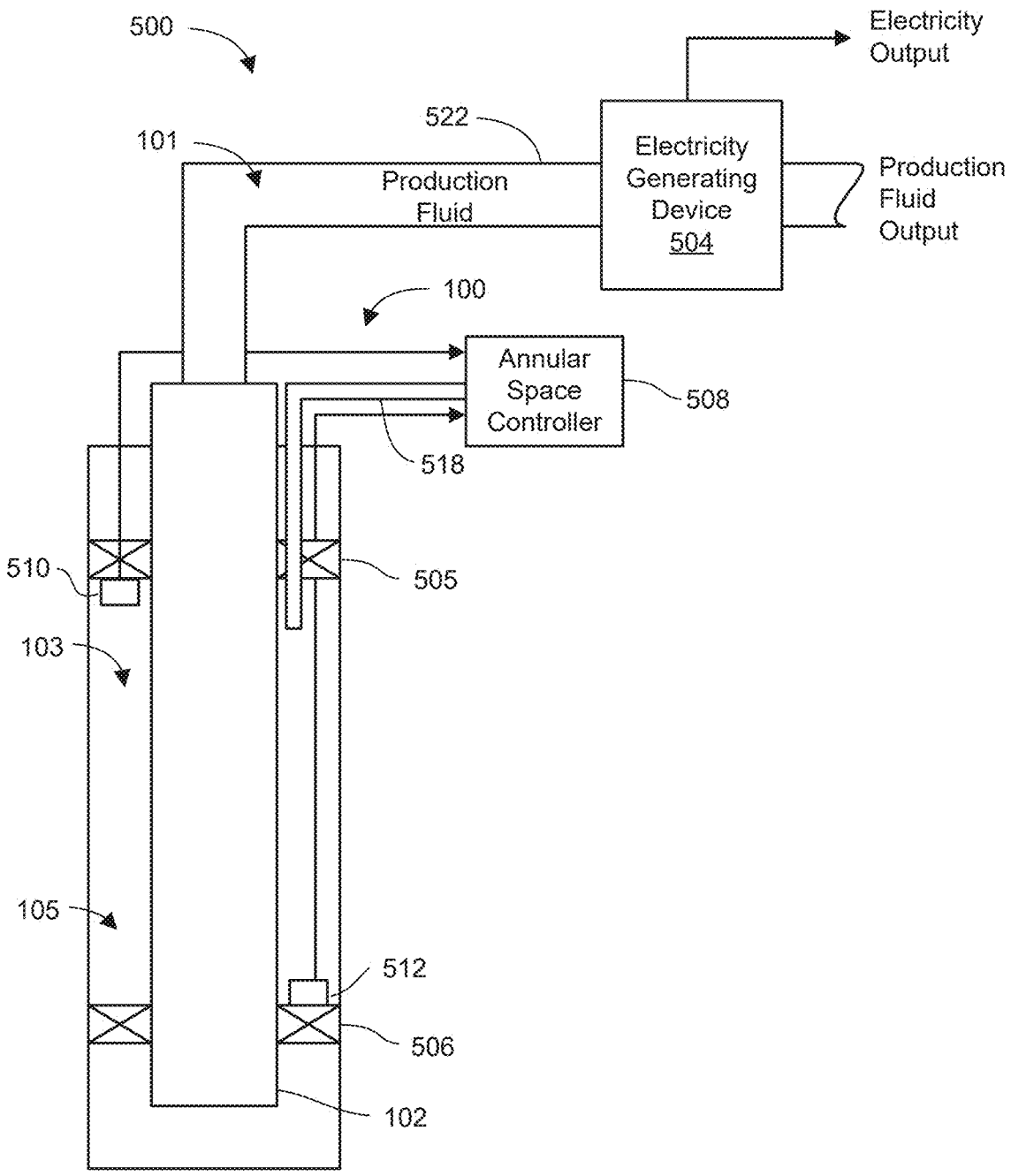
FIG. 5 is a schematic diagram of a system including a wellbore and an electricity generating device according to one or more embodiments.

Additional reference is made to FIG. 5, which illustrates a schematic diagram of a system 500 including the wellbore 100 and an electricity generating device 504. The electricity generating device 504 may be an Organic Rankine Cycle (ORC) device that uses heat in the production fluid 101 to generate electricity. The top of the wellbore 100 shown in FIG. 5 may include a wellhead (not shown in FIG. 5), such as the wellhead 400 described with reference to FIG. 4. The annular space 103 is formed or bounded by a first packer 505 and a second packer 506. The low thermally conductive gas 105 and/or the pressure of the low thermally conductive gas 105 within the annular space 103 may be controlled by an annular space controller 508 as described herein. The annular space controller 508 may control the wellhead 400 described with reference to FIG. 4.

The wellbore 100 may have a first sensor 510 and/or a second sensor 512 located therein. One or both of the first sensor 510 and the second sensor 512 may be located in the annular space 103. Other sensors may be located in other annular spaces. In some embodiments, the sensors 510, 512 may determine the type of low thermally conductive gas 105 in the annular space 103 and/or concentration of the low thermally conductive gas 105. In other embodiments, the sensors 510, 512 may determine types of a plurality of gases located in the annular space 103. For example, the sensors 510, 512 may determine concentrations of nitrogen and carbon dioxide, for example, in the annular space 103.

The annular space controller 508 may include or be coupled to a gas system 518 that controls gas within the annular space 103. The gas system 518 may include a tube or the like that extends into the annular space 103, wherein gases may be forced into or out of the annular space 103 via the tube and instructions executed and/or generated by the annular space controller 508. In some embodiments, the gas system 518 may evacuate air from the annular space 103 and/or introduce the low thermally conductive gas 105 into the annular space 103. The gas system 518 may be a portion of the wellhead 400 (FIG. 4).

During operation of the system 500, the annular space controller 508 may monitor gases within the annular space 103 via the sensors 510, 512. The gases sensed within the annular space 103 may be compared to predetermined values for the gases, the concentration of the low thermally conductive gas 105, and/or the pressure of the gases within the annular space 103. The annular space controller 508 may evacuate gases from the annular space 103 and/or introduce gases, such as the low thermally conductive gas 105 into the annular space 103 in response to the sensed values of gases within the annular space 103. For example, the predetermined value of the low thermally conductive gas 105 may comprise 95 percent nitrogen and be at a specific pressure. If the annular space controller 508 determines a concentration of nitrogen at 90 percent, the 508 may cause the 518 to introduce more nitrogen into the annular space 103 until the concentration is 95 percent.

The production fluid 101 may exit the wellbore 100 or the tubing string 102 and enter a pipe 522 that transports the production fluid 101 to the electricity generating device 504 wherein heat from the production fluid 101 may be extracted and used to produce electricity. Because the system 500 minimizes heat loss from the production fluid 101 as described herein, the heat available to generate electricity by the 504 is greater than in conventional systems.

Figure 6:
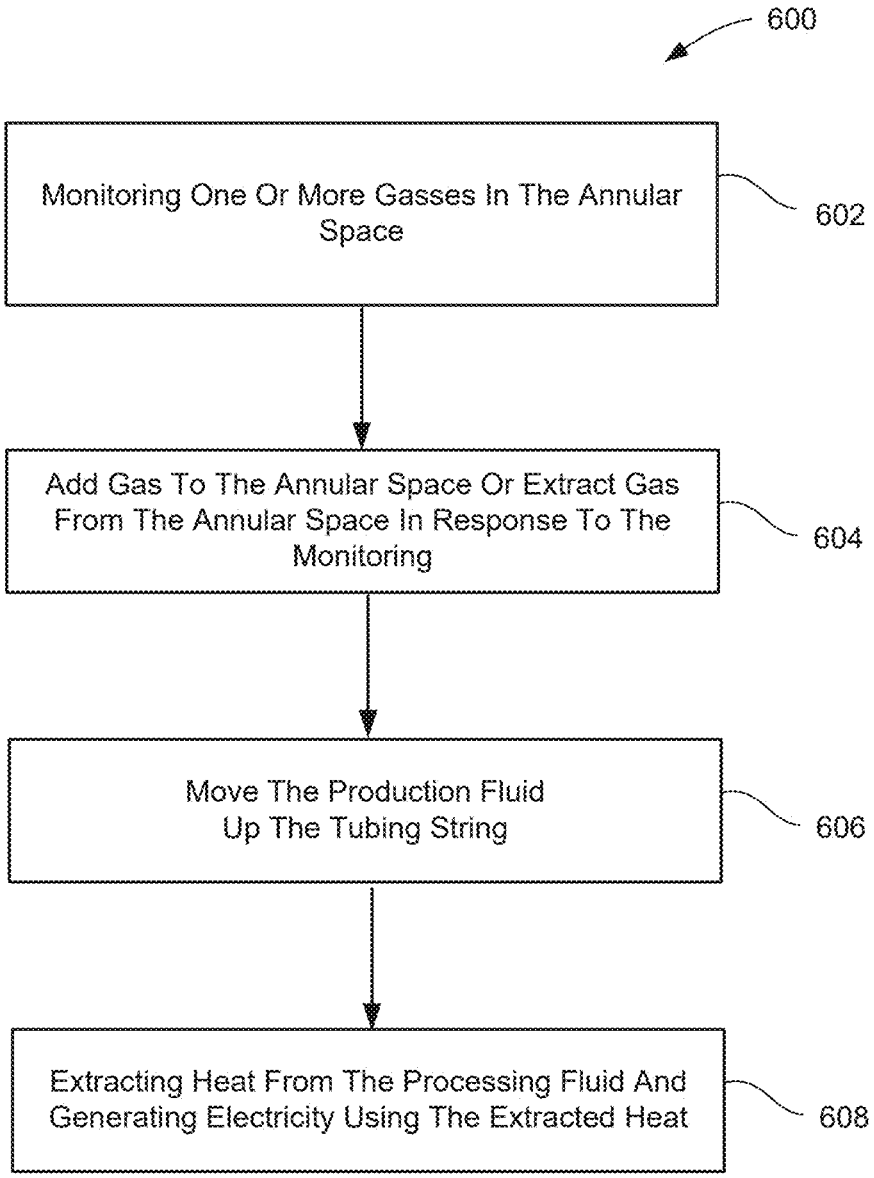
FIG. 6 is a flowchart describing a method of operating the system of FIG. 5 according to one or more embodiments.

Additional reference is now made to FIG. 6, which illustrates a method 600 of operating the system 500 of FIG. 5. The method 600 includes, in processing block 602, monitoring one or more gases in the annular space 103. One of the monitored gases may be the low thermally conductive gas 105. The monitoring may be performed using the sensors 510, 512 and the annular space controller 508. The monitoring may also include monitoring gas pressure in the annular space 103. The method 600 includes, in processing block 604, adding gas to the annular space 103 or extracting gas from the annular space 103 in response to the monitoring. The processes in processing block 604 may be performed at least in part by the annular space controller 508 and the gas system 518.

The method 600 includes, in processing block 606, moving the production fluid 101 up the tubing string 102. Because the low thermally conductive gas 105 is in the annular space 103, the production fluid 101 may lose minimal heat as the production fluid 101 moves up the tubing string 102. The method 600 includes, in processing block 608, extracting heat from the production fluid 101 and generating electricity using the extracted heat. The processes in processing block 608 may be performed at least partially by the electricity generating device 504.

Figure 7:
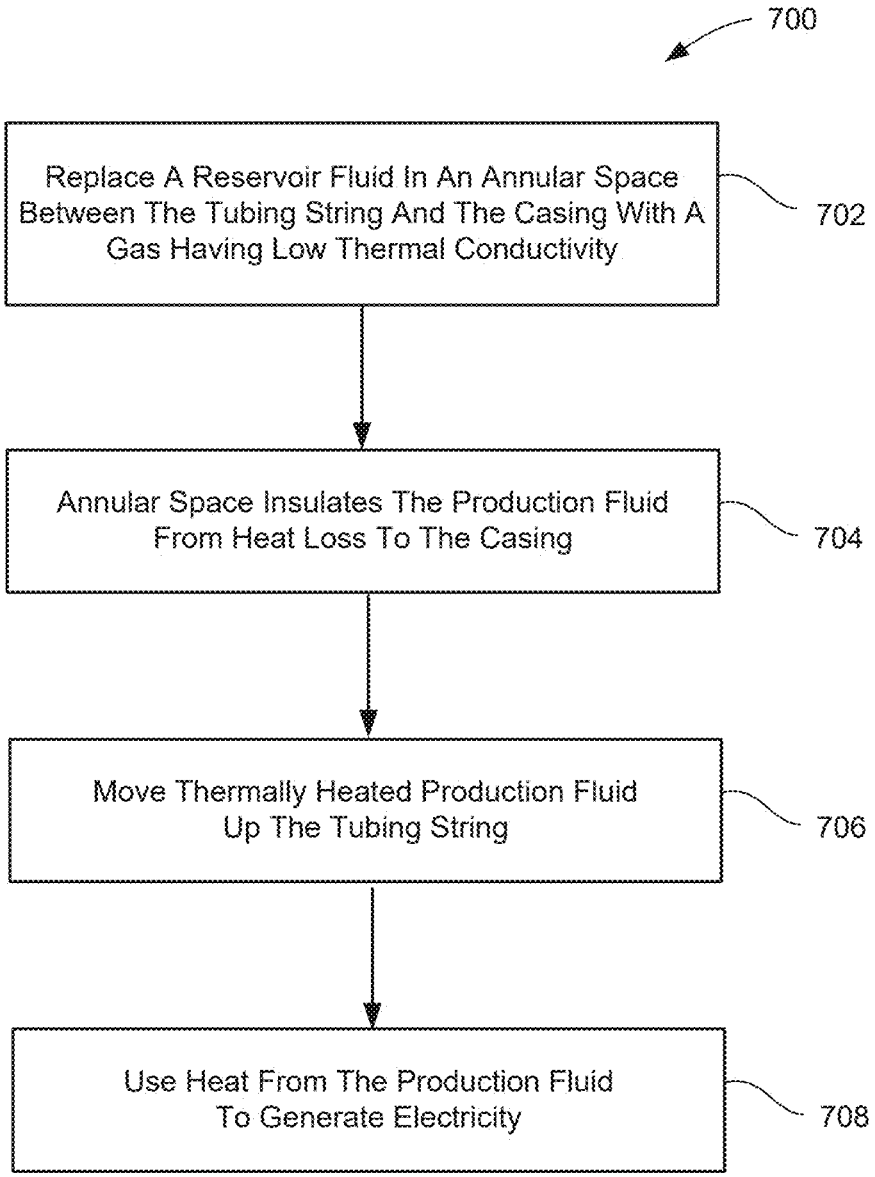
FIG. 7 is a flowchart describing a method of managing a flow of heat of a thermally heated fluid moving up a wellbore according to one or more embodiments.

Additional reference is now made to FIG. 7, which is a flowchart illustrating another method 700 of extracting heat from a production fluid 101 (FIG. 2) moving up the wellbore 100. The method 700 includes, in operational block 702, replacing at least a portion of the reservoir fluid in the annular space 103 between the tubing string 102 and the casing 104 with the low thermally conductive gas 105 such as nitrogen, or carbon dioxide. The processes in operational block 702 may be performed before well production begins. The heat from the moving fluid then convectively moves into the annular space 103 between the tubing string 102 and the outer casing 104 (processing block 706), but at a much reduced rate than if other fluids and/or mud filled the annular space 103, such as with conventional wellbores. Thus, heat loss to the outer casing 104 is minimized over conventional methods and greater thermal energy can be recovered from the production fluid 101 reaching the surface per operational block 704. The method 700 includes, in operational block 706, moving hot production fluid 101 up the tubing string 102 (FIG. 2).

Ater the production fluid 101 has reached the surface, thermal energy from the production fluid 101 may be used to generate electricity per operational block 708, such as by the electricity generating device 504 (FIG. 5). In the embodiments described herein, electricity generating equipment may be provided on a mobile structure, such as a mobile heat exchanger skid. Other structures, such as fixed structures may be used to generate electricity.

Figure 8:
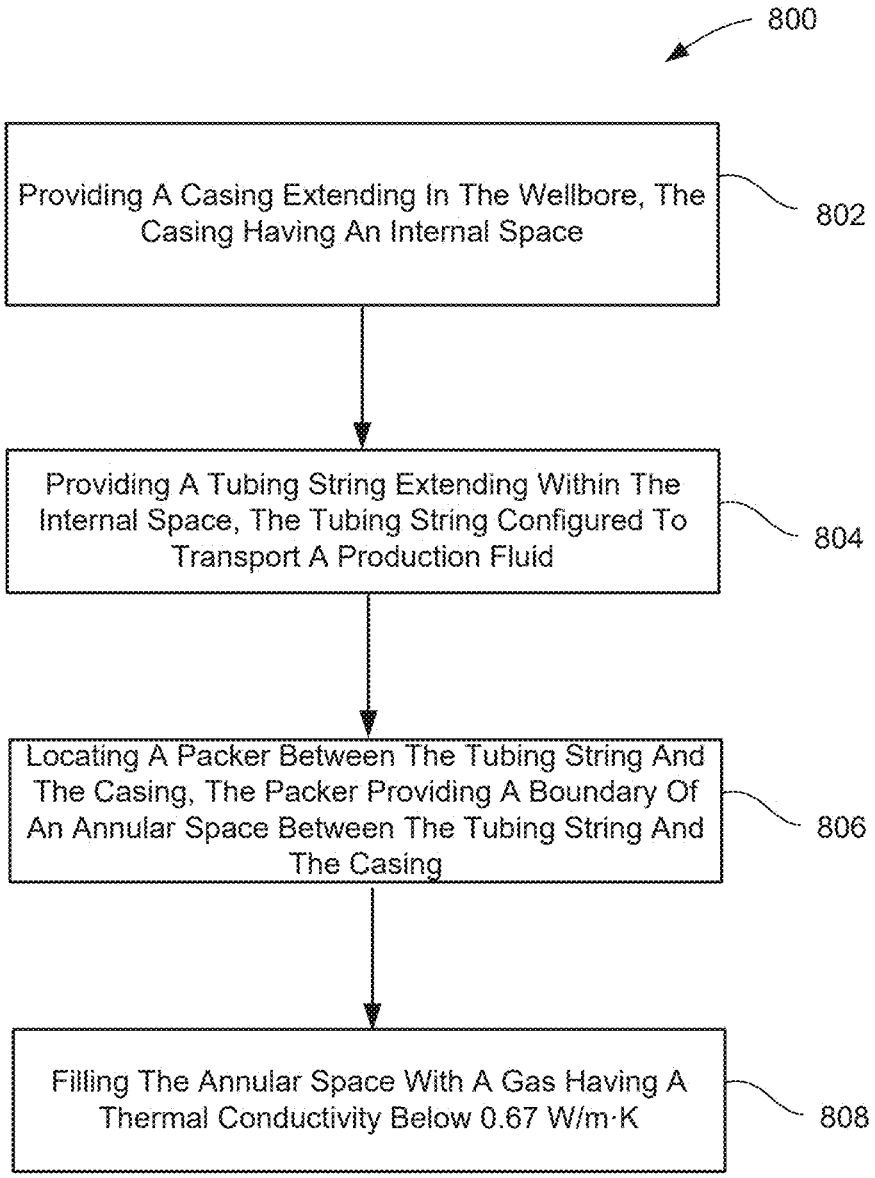
FIG. 8 is a flowchart describing a method of operating a wellbore according to one or more embodiments.

Additional reference is made to FIG. 8, which is a flowchart describing a method 800 of operating a wellbore (e.g., wellbore 100). The method 800 includes, in operational block 802, providing a casing (e.g., casing 104) extending in the wellbore, the casing having an internal space. The method 800 includes, in operational block 804, providing a tubing string (e.g., tubing string 102) extending within the internal space, the tubing string configured to transport a production fluid (e.g., production fluid 101). The method 800 includes, in operational block 806, locating a packer (e.g., packer 206) between the tubing string and the casing, the packer providing a boundary of an annular space (e.g., annular space 103) between the tubing string and the casing. The method 800 includes, in processing block 808, filling the annular space with a gas (e.g., low thermally conductive gas 105) having a thermal conductivity below 0.67 W/m·K.

The foregoing is considered as illustrative only on the principles of the disclosure. Further, since numerous modifications and changes will occur to those skilled in the art, it is not desired to limit the disclosure to the exact construction and operation shown and described, and accordingly, all suitable modifications and equivalents may be resorted to, falling within the scope of the disclosure.

What is claimed is:

1. A system to retain heat in a production fluid being extracted via a wellbore, the system comprising:

a casing extending in the wellbore, the casing having an internal space;

a tubing string extending within the internal space, the tubing string configured to transport the production fluid;

an annular space located between the tubing string and the casing;

a gas having a thermal conductivity below 0.67 W/m·K filling the annular space; and a first packer located between the casing and the tubing string, wherein the first packer is a boundary of the annular space, and wherein the first packer is configured to isolate the gas from a reservoir fluid.

2. The system of claim 1, wherein the gas is nitrogen.

3. The system of claim 1, wherein the gas comprises at least 95% nitrogen.

4. The system of claim 1, wherein the gas comprises at least 50 percent carbon dioxide.

5. The system of claim 1, further comprising a second packer located between the casing and the tubing string, wherein the second packer is a boundary of the annular space.

6. The system of claim 1, further comprising a sensor configured to identify one or more gases in the annular space.

7. The system of claim 6, further comprising an annular space controller configured to identify a leak in the annular space in response to the identifying.

8. The system of claim 1, further comprising a sensor configured to sense a concentration of the gas having a thermal conductivity below 0.67 W/m·K in the annular space.

9. The system of claim 8, further comprising an annular space controller configured to add the gas having a thermal conductivity below 0.67 W/m·K to the annular space in response to the sensing.

10. The system of claim 1, further comprising a sensor configured to measure gas pressure in the annular space.

11. The system of claim 10, further comprising an annular space controller configured to add the gas having a thermal conductivity below 0.67 W/m K to the annular space in response to the measuring.

12. The system of claim 1, further comprising an electricity generating device coupled to the tubing string, the electricity generating device configured to extract heat from the production fluid and generate electricity using the heat.

13. A method of operating a wellbore, the method comprising:

providing a casing extending in the wellbore, the casing having an internal space;

providing a tubing string extending within the internal space, the tubing string configured to transport a production fluid;

locating a packer between the tubing string and the casing, the packer providing a boundary of an annular space between the tubing string and the casing; and filling the annular space with a gas having a thermal conductivity below 0.67 W/m·K.

14. The method of claim 13, further comprising:

sensing a concentration of the gas having a thermal conductivity below 0.67 W/m·K in the annular space; and adding the gas having a thermal conductivity below 0.67 W/m·K to the annular space in response to the sensing.

15. The method of claim 13, further comprising:

sensing a pressure of gas in the annular space; and adding the gas having a thermal conductivity below 0.67 W/m K to the annular space in response to the sensing.

16. The method of claim 13, further comprising:

extracting heat from the production fluid; and using the extracted heat to generate electricity.

17. The method of claim 13, wherein filling the annular space with the gas comprises filling the annular space with nitrogen.

18. The method of claim 13, wherein filling the annular space with the gas comprises filling the annular space with a gas having at least 95 percent nitrogen.

19. A system to generate electricity using heat extracted from a production fluid flowing from a wellbore, the system comprising:

a casing extending in the wellbore, the casing having an internal space;

a tubing string extending within the internal space, the tubing string configured to transport the production fluid;

an annular space located between the tubing string and the casing;

a gas having a thermal conductivity below 0.67 W/m·K filling the annular space;

an annular space controller configured to monitor and regulate a concentration and pressure of the gas having a thermal conductivity below 0.67 W/m·K filling the annular space;

a packer located between the casing and the tubing string, wherein the packer is a boundary of the annular space, and wherein the packer is configured to isolate the gas from a reservoir fluid; and an electricity generating device coupled to the tubing string and configured to extract heat from the production fluid and generate electricity using the extracted heat.

* * * * *